US010563632B2

(12) United States Patent
Martin et al.

(10) Patent No.: US 10,563,632 B2
(45) Date of Patent: Feb. 18, 2020

(54) FUEL INJECTOR

(71) Applicant: Caterpillar Inc., Peoria, IL (US)

(72) Inventors: Glen Clifford Martin, Peoria, IL (US); Jonathan W. Anders, Peoria, IL (US); Robert M. Campion, Chillicothe, IL (US); Bobby John, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 140 days.

(21) Appl. No.: 15/832,295

(22) Filed: Dec. 5, 2017

(65) Prior Publication Data

US 2019/0170103 A1 Jun. 6, 2019

(51) Int. Cl.

| | |
|---|---|
| ***F02M 61/18*** | (2006.01) |
| ***F02M 61/16*** | (2006.01) |
| ***F02M 43/04*** | (2006.01) |

(52) U.S. Cl.

CPC ..... *F02M 61/168* (2013.01); *F02M 43/04* (2013.01); *F02M 61/1806* (2013.01); *F02M 2200/46* (2013.01)

(58) Field of Classification Search

CPC ..... F02M 61/168; F02M 61/1806; F02M 61/1813; F02M 43/04; F02M 61/04; F02M 61/042; F02M 61/045; F02M 2200/46

See application file for complete search history.

(56) References Cited

U.S. PATENT DOCUMENTS

| | | | |
|---|---|---|---|
| 5,765,755 | A | 6/1998 | Peters et al. |
| 6,467,702 | B1 | 10/2002 | Lambert et al. |
| 7,188,790 | B2 | 3/2007 | Astachow et al. |
| 7,243,862 | B2 | 7/2007 | Dingle |
| 10,119,507 | B1 * | 11/2018 | Germano ..... F02M 41/066 |
| 2017/0218909 | A1 | 8/2017 | Mahato et al. |

FOREIGN PATENT DOCUMENTS

| | | |
|---|---|---|
| DE | 102004021538 | 12/2005 |
| EP | 1923566 | 5/2008 |
| GB | 2530767 | 4/2016 |

* cited by examiner

*Primary Examiner* — Jason J Boeckmann
(74) *Attorney, Agent, or Firm* — Oblon, McClelland, Maier & Neustadt

(57) ABSTRACT

A fuel injector includes a nozzle including at least one outer orifice. The at least one outer orifice selectively injects a first fuel. An outer check is disposed movably within the nozzle. The outer check includes at least one first orifice and at least one second orifice. The at least one first orifice and the at least one second orifice are disposed circumferentially spaced apart with respect to one another. Each of the at least one first orifice and the at least one second orifice selectively injects a second fuel. An inner check is disposed movably and concentrically within the outer check. The at least one outer orifice is adapted to selectively injects at least one of the first fuel and the second fuel therethrough based on a position of each of the outer check and the inner check.

20 Claims, 8 Drawing Sheets

FUEL INJECTOR

TECHNICAL FIELD

The present disclosure relates to a fuel injector. More specifically, the present disclosure relates to a fuel injector for an internal combustion engine.

BACKGROUND

An internal combustion engine generally combusts a fuel to produce mechanical power. Introduction of the fuel into a cylinder of the internal combustion engine is most commonly achieved using a fuel injector. A commonly used injector is a closed-nozzle injector which includes a nozzle assembly having a spring-biased needle valve element positioned adjacent an injector nozzle for allowing the fuel to be injected into the cylinder of the internal combustion engine. The needle valve element moves to allow the fuel to pass through the injector nozzle and out of injector orifices or spray holes, thus marking the beginning of a fuel injection event.

Fuel injectors typically provide a single injection profile based on structural characteristics of the fuel injector such as number of orifices, cross-section area of orifices etc. A change in functional requirement or an application area of the engine in which the fuel injector is being used may need variation in injection profile. Such variation typically may not be provided by a single fuel injector, and multiple fuel injectors may be required for providing different injection profiles.

German Patent Application Number DE 10200/4021538 describes a fluid flow control valve. The fluid flow control valve includes two coaxial valve needles. An inner needle is completely enclosed inside an outer needle. Flow of fuel to jets in the outer needle is blocked by the inner needle. Large diameter jets in the hollow conical nozzle body are provided in line with the jets in the outer needle. The outer needle blocks additional flow to jets in a conical nozzle. The inner and the outer needles together provide a set of injection openings to inject fuel into the combustion chamber.

SUMMARY

In an aspect of the present disclosure, a fuel injector is provided. The fuel injector includes a nozzle including at least one outer orifice. The at least one outer orifice selectively injects a first fuel. The fuel injector includes an outer check disposed movably within the nozzle. The outer check includes at least one first orifice and at least one second orifice. The at least one first orifice and the at least one second orifice are disposed circumferentially spaced apart with respect to one another. Each of the at least one first orifice and the at least one second orifice selectively inject a second fuel. The fuel injector further includes an inner check disposed movably and concentrically within the outer check. The at least one outer orifice is adapted to selectively inject at least one of the first fuel and the second fuel therethrough based on a position of each of the outer check and the inner check.

In another aspect of the present disclosure, a fuel injection system is provided. The fuel injection system includes a first fuel source adapted to provide a first fuel. The fuel injection system includes a second fuel source adapted to provide a second fuel. The fuel injection system includes a fuel injector provided in fluid communication with each of the first fuel source and the second fuel source. The fuel injector includes a nozzle having at least one outer orifice. The at least one outer orifice selectively injects the first fuel. The fuel injector includes an outer check disposed movably within the nozzle. The outer check includes at least one first orifice and at least one second orifice. The at least one first orifice and the at least one second orifice are disposed circumferentially spaced apart with respect to one another. Each of the at least one first orifice and the at least one second orifice selectively injects the second fuel. The fuel injector further includes an inner check disposed movably and concentrically within the outer check. The at least one outer orifice is adapted to selectively inject at least one of the first fuel and the second fuel therethrough based on a position of each of the outer check and the inner check. The fuel injection system further includes a controller communicably coupled to each of the first fuel source, the second fuel source, and the fuel injector.

In yet another aspect of the present disclosure, a method for controlling a fuel injector is provided. The fuel injector includes a nozzle, an outer check, and an inner check. The method includes providing flow of a first fuel to the fuel injector. The method includes providing flow of a second fuel to the fuel injector. The method includes controlling a position of the outer check. The method includes selectively injecting the first fuel through at least one outer orifice. The method includes controlling a position of the inner check. The method includes selectively injecting the second fuel through any one of at least one first orifice and at least one second orifice. The method further includes selectively injecting at least one of the first fuel and the second fuel through the at least one outer orifice.

DETAILED DESCRIPTION

Figure 1:
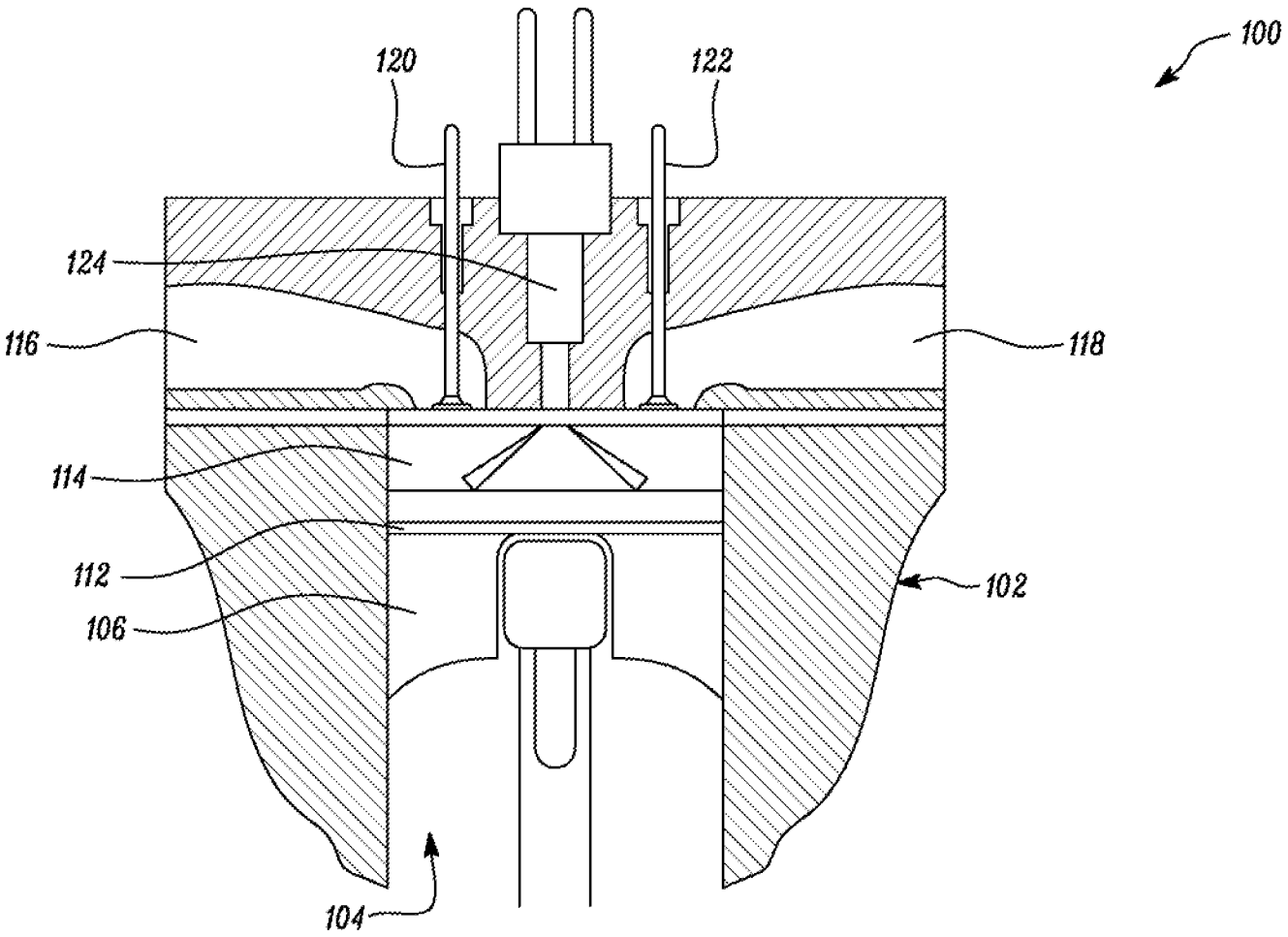
FIG. 1 illustrates an exemplary engine, in accordance with an embodiment of the present disclosure.

Wherever possible, the same reference numbers will be used throughout the drawings to refer to same or like parts. FIG. 1 illustrates an exemplary engine 100. The engine 100 is an internal combustion engine powered by any fuel known in the art, such as natural gas, diesel, or gasoline. In some embodiments, the engine 100 may be associated with a machine (not shown) including, but not limited to, a locomotive, a marine vessel, a land vehicle, and a power generator. The engine 100 and/or the machine may be employed in any industry including, but not limited to, construction, agriculture, forestry, mining, transportation, waste management, aviation, marine, material handling, and power generation.

The engine 100 includes an engine block 102. The engine block 102 defines a cylinder 104 within the engine block 102. It should be contemplated that only one cylinder 104 is illustrated fir sake of clarity, and explanation. There may be any number of cylinders provided with the engine 100 based on operational requirements of the engine 100. The cylinder 104 includes a piston 106. The piston 106 is adapted to translate inside the cylinder 104 between a top dead center and a bottom dead center. The piston 106 is provided with a piston ring 112. The piston ring 112 limits leakage of any gases from between the piston 106 and the cylinder 104. The cylinder 104 and the piston 106 together define a combustion chamber 114 for combusting a mixture of a fuel and an oxidant therein.

The combustion chamber 114 is coupled to each of an intake manifold 116 and an exhaust manifold 118 through an inlet valve 120 and an outlet valve 122 respectively. The inlet valve 120 allows inlet of the oxidant through the intake manifold 116 inside the combustion chamber 114. The oxidant is compressed inside the combustion chamber 114. The combustion chamber 114 is then provided with at least one of a first fuel and a second fuel through a fuel injector 124. Accordingly, the exhaust manifold 118 is adapted to receive an exhaust flow from the cylinder 104 through the outlet valve 122. Additionally, the engine 100 may include various other components and/or systems (not shown) including, but not limited to, a crankcase, a fuel system, an air system, a cooling system, a lubrication system, a turbocharger, an exhaust gas recirculation system, and peripheries, among others.

Figure 2:
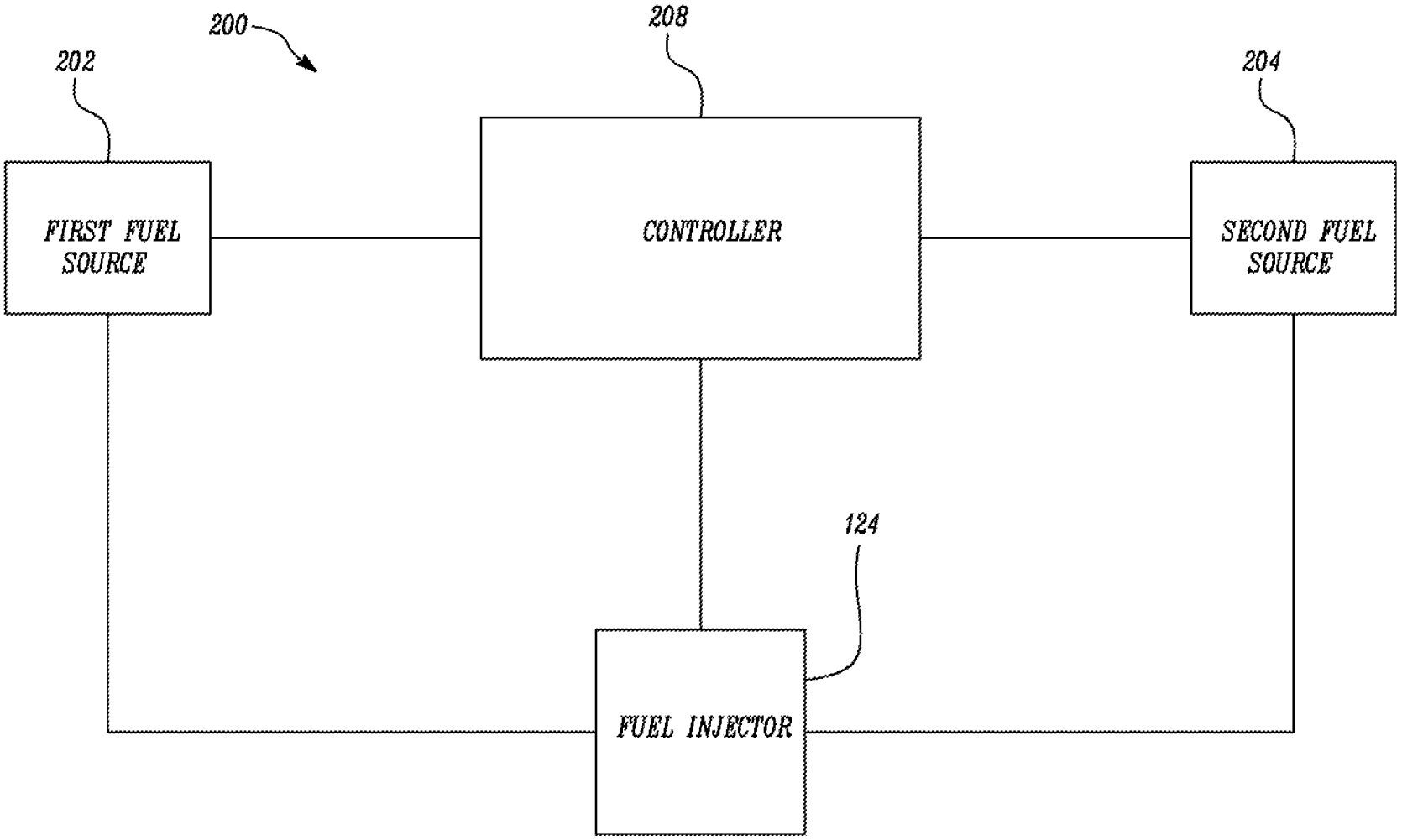
FIG. 2 schematically illustrates a fuel injection system for the engine of FIG. 1, in accordance with an embodiment of the present disclosure.

FIG. 2 shows a block diagram representing a fuel infection system 200 for the engine 100. The fuel injection system 200 includes a first fuel source 202. The first fuel may be any one of natural gas, alcohol, diesel, or gasoline etc. The first fuel source 202 is configured to store the first fuel, and supply the first fuel to the engine 100 as per operational requirements of the engine 100. The first fuel source 202 may be a fuel tank, a reservoir etc., which may store the first fuel, and may include associated parts and components required to supply the first fuel to the engine 100.

The fuel injection system 200 includes a second fuel source 204. The second fuel may be any one of natural gas, alcohol, diesel, or gasoline etc. The second fuel source 204 is configured to store the second fuel, and supply the second fuel to the engine 100 as per operational requirements of the engine 100. The second fuel source 204 may be a storage tank, or a reservoir etc., which may store the second fuel, and may include associated parts and components required to supply the second fuel to the engine 100. The first fuel and the second fuel may be similar or different from each other. In one embodiment, the first fuel and the second fuel are the same fuel such as diesel, gasoline, natural gas, alcohol etc. In another embodiment, the first fuel and the second fuel may be any combination of two different fuels such as diesel and natural gas, natural gas and gasoline etc.

The fuel injection system 200 includes a controller 208. The controller 208 may be a single controller, or a group of multiple controllers configured to control various aspects of operation of the engine 100. The controller 208 may be a microprocessor, a field programmable gate array (FPGA), or any other such component which may perform functions intended of a controller. The controller 208 is communicably coupled to the first fuel source 202 and the second fuel source 204. The controller 208 may control supply of the first fuel and the second fuel from the first fuel source 202 and the second fuel source 204 respectively, to provide an appropriate sequential injection strategy of the first fuel and the second fuel to be supplied to the engine 100.

The fuel injection system. 200 further includes the fuel injector 124. The fuel injector 124 is configured to selectively inject the first fuel and/or the second fuel into the cylinder 104. The fuel injector 124 is communicably coupled with the controller 208 such that the controller 208 may control operation of the fuel injector 124. The fuel injector 124 is also coupled with the first fuel source 202 and the second fuel source 204 such that the first fuel source 202 and the second fuel source 204 may supply the first fuel and the second fuel respectively to the fuel injector 124. The controller 208 may control supply of the first fuel and the second fuel from the first fuel source 202 and the second fuel source 204 respectively to the fuel injector 124 as required.

Figure 3B:
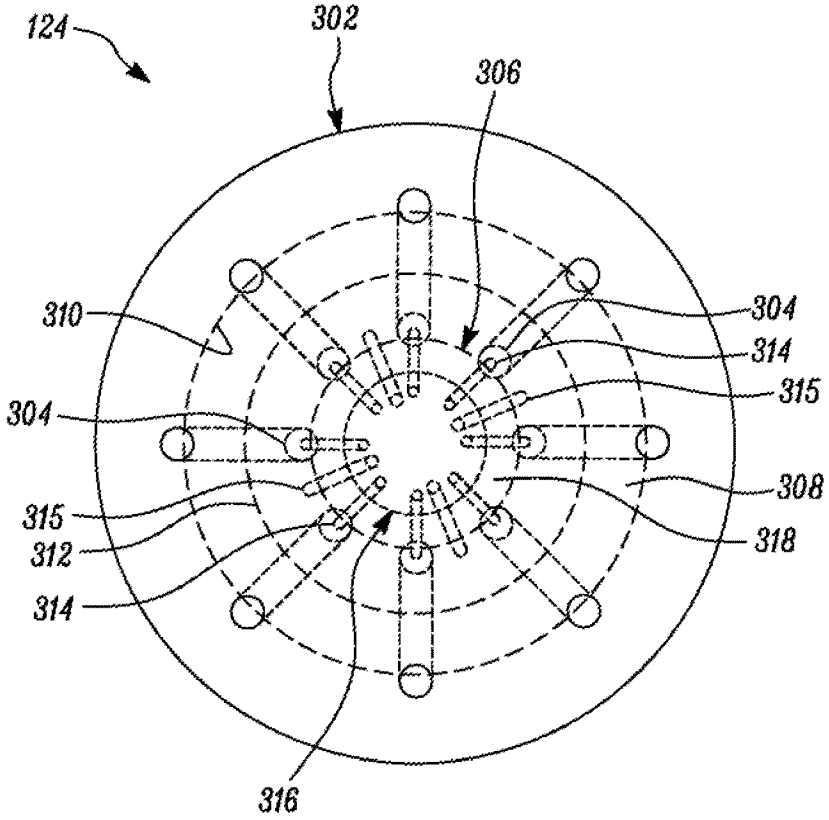
FIG. 3B illustrates a bottom view of the fuel injector corresponding to FIG. 3A, in accordance with art embodiment of the present disclosure.
Figure 3A:
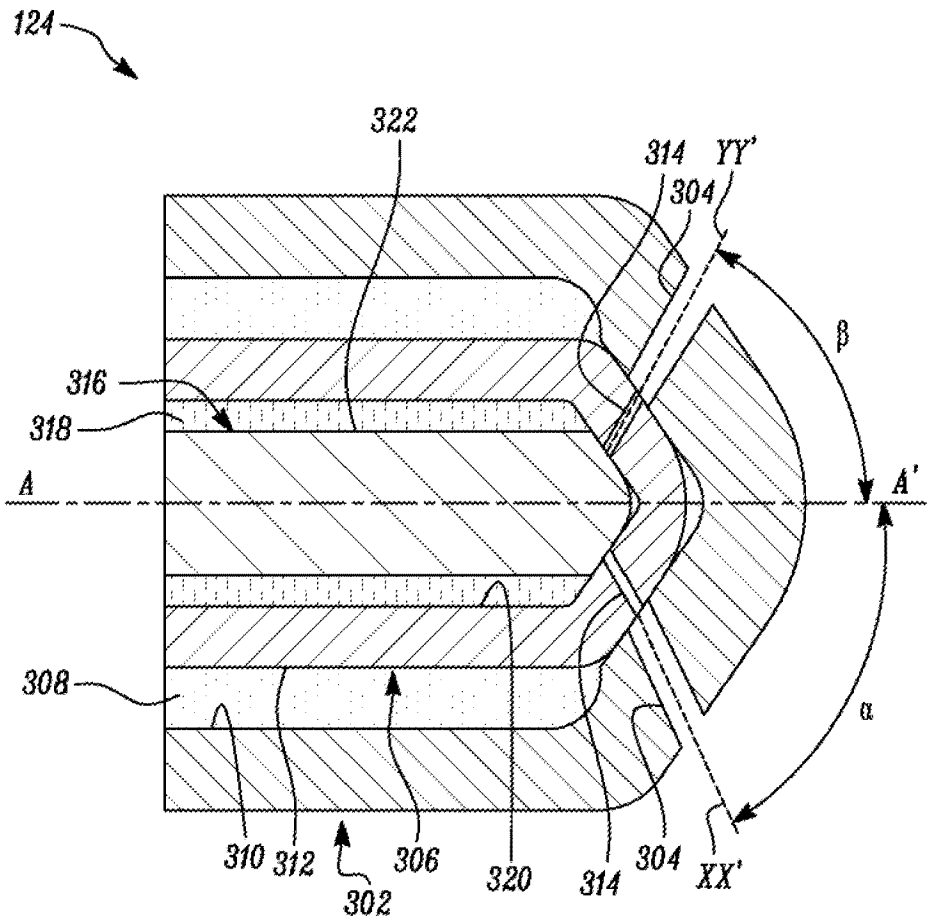
FIG. 3A illustrates a partial sectional view of a fuel injector, in accordance with an embodiment of the present disclosure.

FIG. 3A shows a partial sectional view of the fuel injector 124. The fuel injector 124 includes a nozzle 302. The nozzle 302 has a substantially cylindrical structure, which tapers towards an end to form a substantially conical structure. The nozzle 302 defines at least one outer orifice 304 within the conical structure. In one embodiment, the outer orifice 304 includes a plurality of outer orifices 304 within the nozzle 302 of the fuel injector 124 which are concentrically spaced apart with respect to each other. In the illustrated embodiment, the nozzle 302 includes eight outer orifices 304. Although only two of the eight outer orifices 304 are visible in the sectional view, it should be contemplated that the nozzle 302 includes the eight outer orifices 304 circumferentially spaced apart from each other. It should be contemplated that the nozzle 302 may include any number of the outer orifices 304 as per application requirements.

The outer orifice 304 may be an opening, or a hole defined within the nozzle 302 to allow flow of the first fuel through the nozzle 302 along a first spray axis X-X'. A central axis A-A' passes symmetrically through the fuel injector 124. The outer orifices 304 are defined by the nozzle 302 symmetrically about the axis A-A'. The outer orifices 304 define a first included angle "α'". It may be contemplated that all of the outer orifices 304 are located in a circular configuration (not shown) having a center lying on the central axis A-A'. The first included angle "α" may be defined as an angle included between any two outer orifices 304 located diametrically opposite to each other. In some embodiments, when there may be fewer or more than eight outer orifices 304, all the outer orifices 304 may be provided at similar respective first included angle "α".

FIG. 3B is a bottom view of the fuel injector 124. With combined reference to FIGS. 3A and 3B, the nozzle 302 has a hollow structure. The fuel injector 124 includes an outer check 306. The outer check 306 is disposed movably within the nozzle 302 along the axis A-A'. The outer check 306 is provided within the nozzle 302 such that the outer check 306 may translate along the axis A-A'. The outer check 306 may move between a closed position (as illustrated in FIGS. 3A-31B, 4A-4B, 5A-5B, 7A-7C) and an open position (as illustrated in FIGS. 6A-6C). The outer check 306 may also rotate about the axis A-A'.

The controller 208 may be operatively coupled with the fuel injector 124 such that the controller 208 may control the movement of the outer check 306 within the nozzle 302 between the open position and the closed position. The controller 208 may also control the rotational motion of the outer check 306 within the nozzle 302. The outer check 306 and the nozzle 302 define a first passage 308. The first passage 308 is disposed concentrically between the outer check 306 and the nozzle 302. The first passage 308 may be coupled to the first fuel source 202, and the first fuel may be supplied through the first passage 308. More specifically, the first passage 308 is defined between an inner surface 310 of the nozzle 302, and an outer surface 312 of the outer check 306.

The outer check 306 has a substantially cylindrical structure, which tapers towards an end to form a substantially conical structure. The outer check 306 defines at least one first orifice 314 within the conical structure. In one embodiment, the at least one first orifice 314 includes a plurality of first orifices 314 within the outer check 306 concentrically spaced apart from each other. In the illustrated embodiment, the outer check 306 includes eight first orifices 314. It should be contemplated that the outer check 306 may include any number of the first orifices 314 as per application requirements. In an embodiment, the outer check 306 may include a single first orifice 314. In another embodiment, number of the first orifices 314 may be less than or equal to number of the outer orifices 304.

The first orifice 314 is an opening, or a hole defined by the outer check 306 to allow flow of a fluid through the outer check 306 along a second spray axis Y-Y'. The first orifices 314 are defined by the outer check 306 symmetrically about the axis A-A'. The first orifices 314 define a second included angle "β". It may be contemplated that all of the first orifices 314 are located in a circular configuration. (not shown) having a center lying on the central axis A-A'. The second included angle "β" may be defined as an angle included between any two first orifices 314 located diametrically opposite to each other. The second included angle "β" is same for both the first orifices 314. It should be contemplated that the outer check 306 may include any number of first orifices 314, as per application requirements. In an embodiment, the outer check 306 may include a single second first orifice 314, in another embodiment, the number of first orifices 314 may be less than or equal to the number of outer orifices 304. The second included angle "β" may be similar to, or different than the first included angle "α". The present disclosure is not limited by values of the first included angle "α" and the second included angle "β" in any manner. Values of the first included angle "α" and the second included angle "β" are provided in a range such that first orifices 314 align with the outer orifices 304 for all values of the first included angle "α" and the second included angle "β". Further, a cross-sectional area of the outer orifice 304 is either equal to, or greater than a cross-sectional area of the first orifice 314.

The outer check 306 further defines at least one second orifice 315 within the conical structure. In one embodiment, the at least one second orifice 315 includes a plurality of second orifices 315 concentrically spaced apart with respect to each other, and with respect to the plurality of the first orifices 314. In the illustrated embodiment, the outer check 306 includes four second orifices 315. It should be contemplated that the outer check 306 may include any number of second orifices 315. In an embodiment, the outer check 306 may include a single second orifice 315. In another embodiment, the number of second orifices 315 may be less than or equal to the number of outer orifices 304. In another embodiment, number of the second orifices 315 may be less than or equal to number of the outer orifices 304. In another embodiment, the number of second orifices 315 may be provided in a fraction multiple of the number of outer orifices 304, for example the number of second orifices 315 may be one half of the number of outer orifices 304, one third of the number of outer orifices 304, one fourth of the number of outer orifices 304 etc.

The second orifice 315 is an opening, or a hole defined by the outer check 306 to allow flow of a fluid through the outer check 306 along a third spray axis Z-Z'. The second orifices 315 are defined by the outer check 306 symmetrically about the axis A-A'. The second orifices 315 define a third included angle "γ" (shown in FIG. 5). It may be contemplated that all of the second orifices 315 are located in a circular configuration (not shown) having a center lying on the central axis A-A'. The third included angle "γ" may be defined as an angle included between any two first orifices 314 located diametrically opposite to each other. The third included angle "γ" may be the same for all the second orifices 315. In some embodiments, when there may be fewer or more than four second orifices 315, all the second orifices 315 may be provided at similar respective third included angles "γ". The third included angle "γ" may be similar to, or different than the first included angle "α", and the second included angle "β". The present disclosure is not limited by values of the first included angle "α", the second included angle "β", and the third included angle "γ" in any manner. Values of the first included angle "α" and the third included angle "γ" are provided in a range such that second orifices 315 align with the outer orifices 304 for all values of the first included angle "α" and the third included angle "γ". Further, the cross-sectional area of the outer orifice 304 is either equal to, or greater than a cross-sectional area of the second orifice 315.

Figures 6A, 6B, 6C:
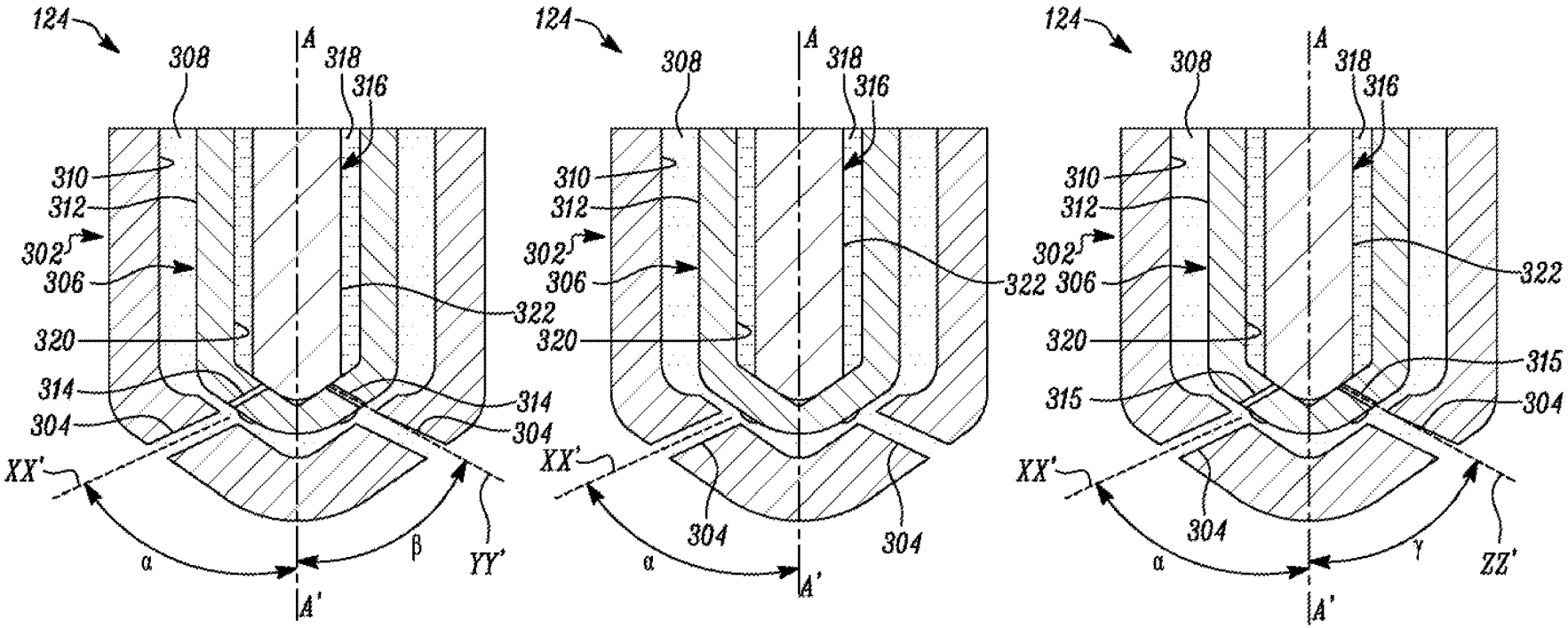
FIGS. 6A-6C show partial sectional views of the fuel injector of FIG. 3A in various operating positions, in accordance with an embodiment of the present disclosure.
Figure 7C:
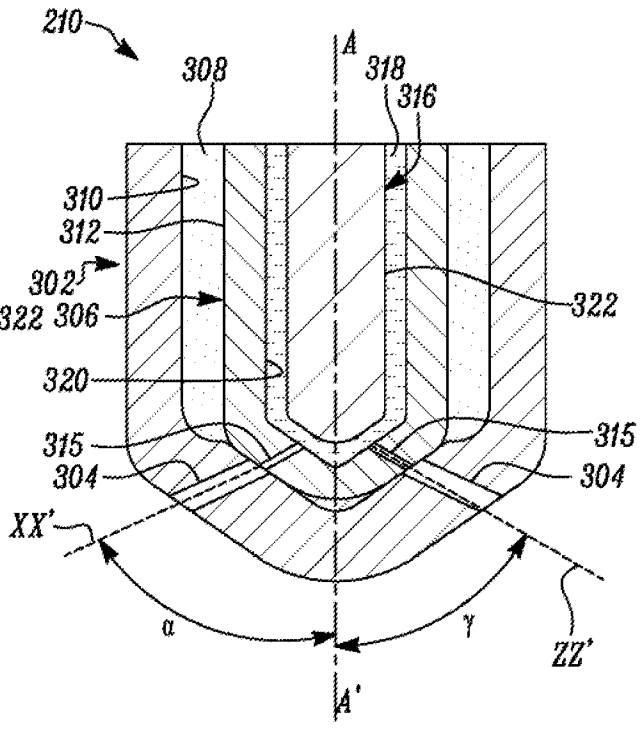
FIGS. 7A-7C show partial cross-sectional views of the fuel injector of FIG. 3A in other operating positions, in accordance with an embodiment of the present disclosure.
Figure 7B:
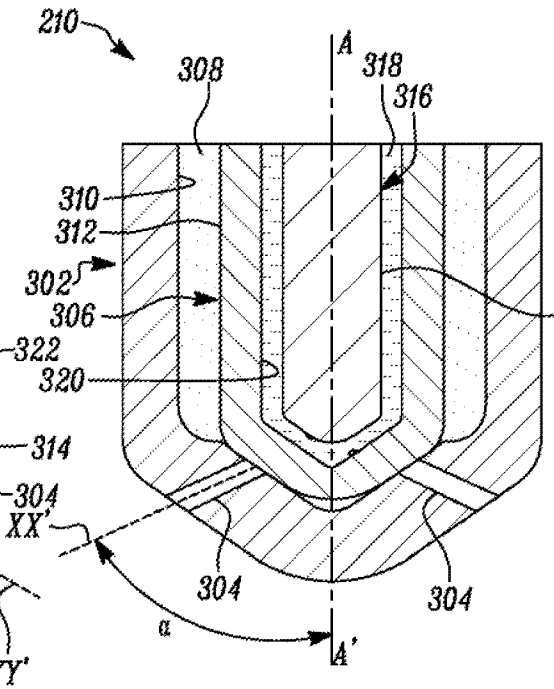
Figure 7A:
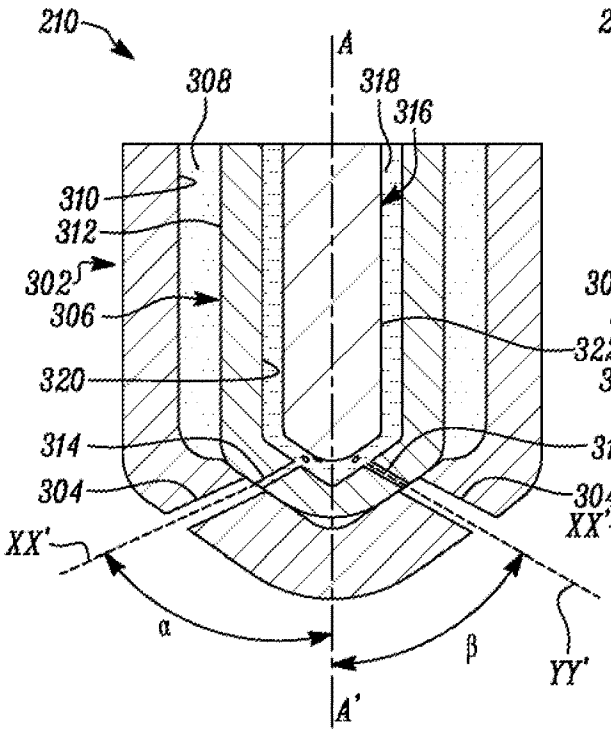

The outer check 306 has a hollow structure. The fuel injector 124 further includes an inner check 316 provided within the outer check 306. The inner chock 316 is disposed within the outer check 306 and is concentric with respect to the outer check 306 about the axis A-A'. The inner check 316 has a substantially cylindrical structure, which tapers towards an end to form a substantially conical structure. The inner check 316 is provided within the outer check 306 such that the inner check 316 may translate along the axis A-A'. The inner check 316 may also rotate about the axis A-A'. The inner check 316 may move between a closed position (as illustrated in FIGS. 3A-3B, 4A-4B, 5A-5B, and 6A-6C) and an open position (as illustrated in FIGS. 7A-7C).

The controller 208 may be operatively coupled with the fuel injector 124 such that the controller 208 may control the movement of the inner check 316 within the outer check 306 between the open position and the closed position. The controller 208 may also control rotational motion of the inner check 316 within the outer check 306. The controller 208 may control the translational and rotational movement of the outer check 306 and the inner check 316 independently of each other. Also, the movement of the outer check 306 and the inner check 316 may be independent of each other.

The inner check 316 and the outer check 306 define a second passage 318 disposed concentrically between the inner check 316 and the outer check 306. The second passage 318 may be coupled to the second fuel source 204, and the second fuel may be supplied through the second passage 318. More specifically, the second passage 318 is defined between an inner surface 320 of the outer check 306, and an outer surface 322 of the inner check 316.

The controller 208 controls the rotational motion of the outer check 306 within the nozzle 302. The controller 208 may control the rotation attic outer check 306 such that the first orifices 314 and the second orifices 315 are selectively aligned with the outer orifices 304 as per application requirements. The plurality of first orifices 314 and the plurality of second orifices 315 are adapted to selectively align with the plurality of outer orifices 304, and inject at least one of the first fuel and the second fuel through the outer orifices 304. When the first orifices 314 align with the outer orifices 304, a first injection pattern may be observed. Referring to FIG. 3B, the plurality of first orifices 314 is aligned with the plurality of outer orifices 304. However, as the outer check 306 is in the closed position, flow of the first fuel is limited through the first passage 308. Also, as the inner check 316 is in the closed position, flow of the second fuel is limited through the second passage 318.

Figure 4B:
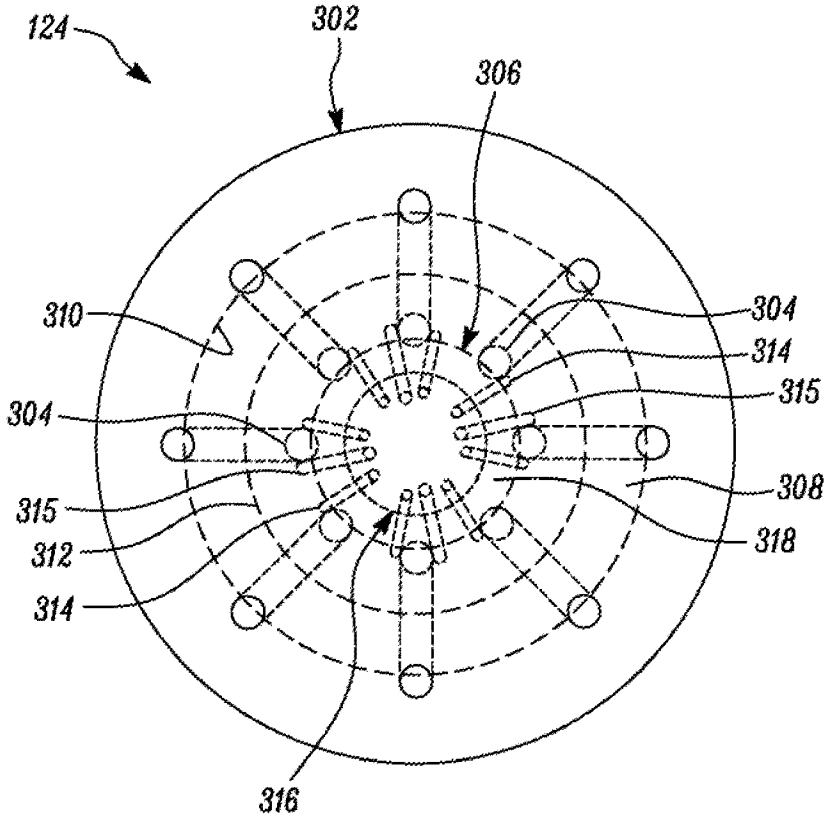
FIG. 4B illustrates a bottom view of the fuel injector corresponding to FIG. 4A, in accordance with an embodiment of the present disclosure.
Figure 4A:
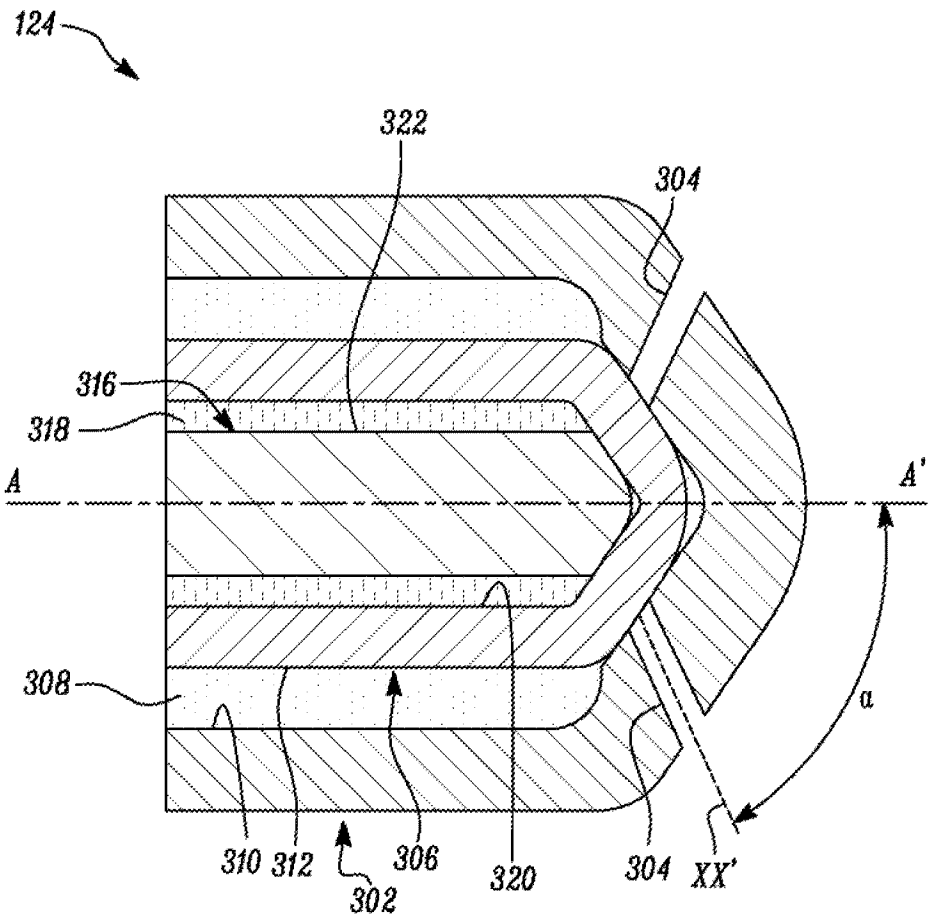
FIG. 4A illustrates another partial sectional view of the fuel injector of FIG. 3A, in accordance with an embodiment of the present disclosure.

FIG. 4A shows partial sectional view of the fuel injector 124 with both the outer check 306 and the inner check 316 in the closed position, and FIG. 4B shows the bottom view of the fuel injector 124. The outer check 306 is shown rotated by an angle within the nozzle 302 relative to the configuration shown in FIG. 3. In the illustrated configuration, both the plurality of first orifices 314 and the plurality of second orifices 315 are misaligned with the plurality of outer orifices 304. Accordingly, flow of the second fuel through the outer check 306 is limited. The plurality of first orifices 314 and the plurality of second orifices 315 are blocked by the inner surface 310 of the nozzle 302, and are therefore closed to transfer the second fuel through the outer check 306. Also, as the outer check 306 is in the closed position, flow of the first fuel through the first passage 308 and the outer orifices 304 is limited.

Figure 5B:
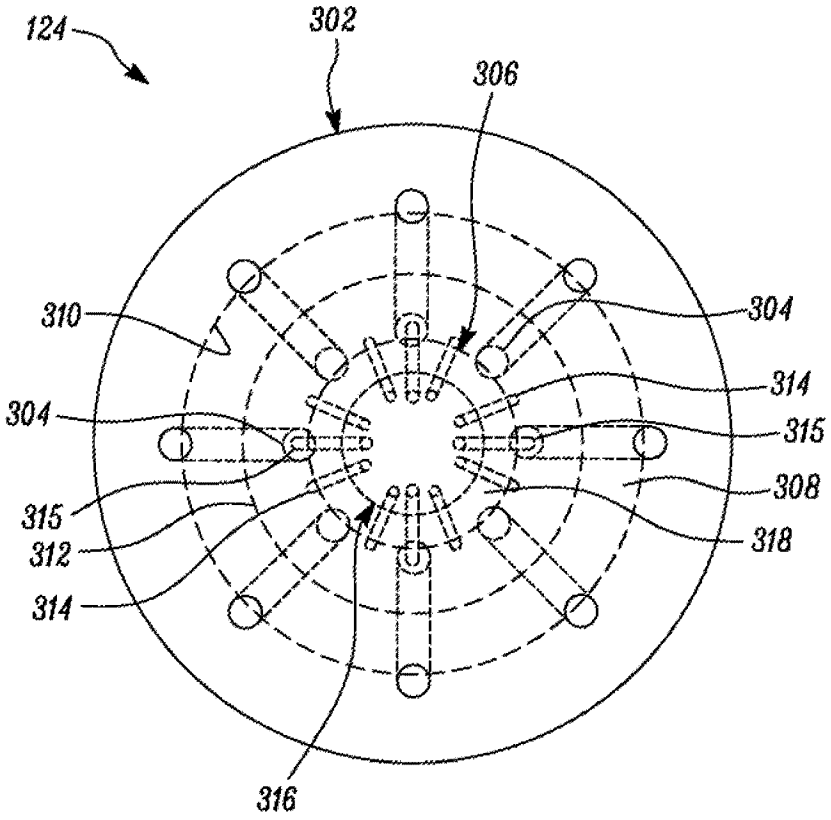
FIG. 5B illustrates a bottom view of the fuel injector corresponding to FIG. 5A, in accordance with an embodiment of the present disclosure.
Figure 5A:
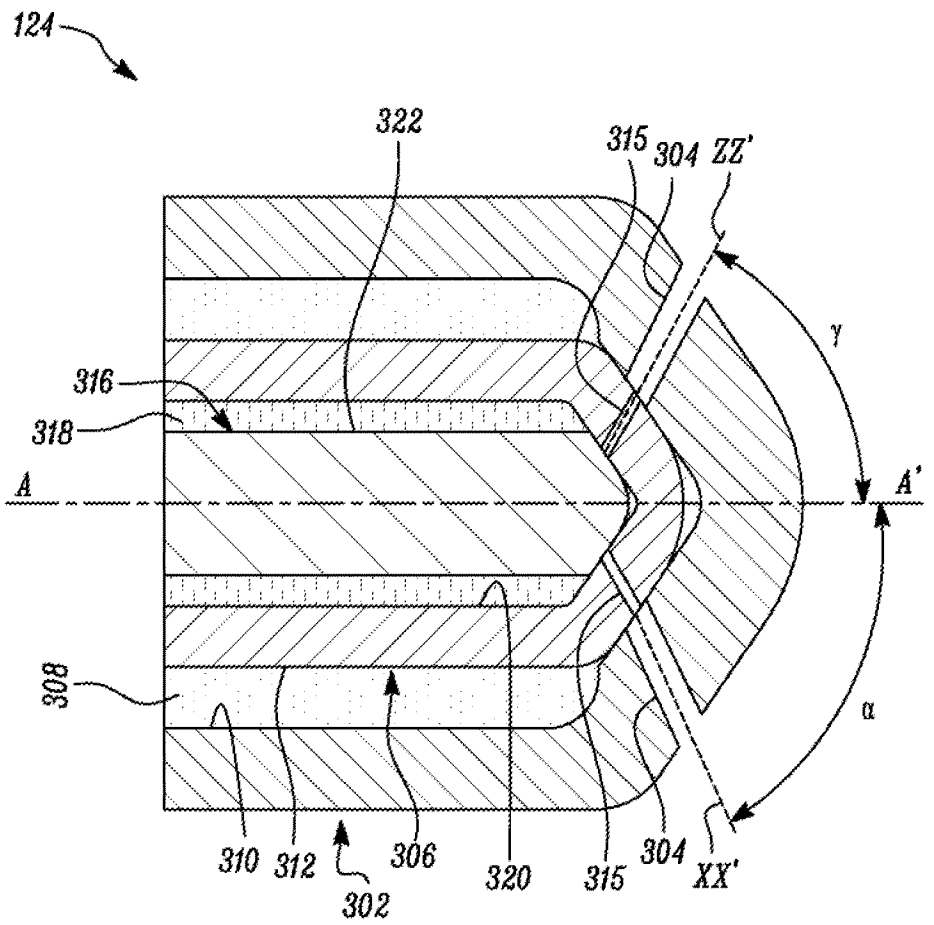
FIG. 5A illustrates another partial sectional view of the fuel injector of FIG. 3A, in accordance with an embodiment of the present disclosure.

FIG. 5A shows a partial cross-sectional view of the fuel injector 124 showing the plurality of second orifices 315 aligned with the plurality of outer orifices 304, and FIG. 5B shows the corresponding bottom view of the fuel injector 124. With combined reference to FIGS. 5A and 5B, there are four second orifices 315, which align with four of the eight outer orifices 304. Accordingly, at the same time, the plurality of first orifices 314 are blocked by the inner surface 310 of the nozzle 302 and limits passage of the second fuel from the first orifices 314. However, as illustrated in FIG. 5A, as the outer check 306 is in the closed position, flow of the first fuel through the first passage 308 and the outer orifices 304 is limited. Also, as the inner check 316 is in the closed position, flow of the second fuel is limited through the second passage 318 and the second orifices 315.

Now referring to FIGS. 6A-6C, the outer check 306 is shown in the open position, and the inner check 316 is shown in the closed position. The controller 208 may control the rotational movement of the outer check 306 to selectively align any one of the plurality of first orifices 314 and the plurality of second orifices 315 as per operational requirements of the engine 100, as both the plurality of first orifices 314 and the plurality of second orifices 315 may offer different injection patterns and profiles. FIG. 6A corresponds to the configuration in which the plurality of first orifices 314 aligns with the plurality of outer orifices 304. However, as the inner check 316 is in closed position, the inner check 316 limits flow of the second fuel through the plurality of first orifices 314 and, second orifices 315. The first fuel flows through the first passage 308, and is injected in the cylinder 104 through the plurality of outer orifices 304.

Referring to FIG. 6B, the outer Check 306 is in the open position, and the inner check 316 is shown in the closed position. However, the outer check 306 is shown rotated by an angle with respect to the configuration shown in FIG. 6A. Both the plurality of first orifices 314 and the plurality of second orifices 315 are misaligned with the plurality of outer orifices 304. However, as the inner check 316 is in closed position, the inner check 316 limits flow of the second fuel through the plurality of first orifices 314 and second orifices 315. In this configuration as well, the first fuel flows through the first passage 308, and then through the plurality of outer orifices 304 and gets injected in the cylinder 104 through the plurality of outer orifices 304.

Now referring to FIG. 6C, the outer check 306 is shown in the open position and the inner check 316 is shown in the closed position. The outer check 306 is shown further rotated as compared to the configuration shown in FIG. 6B such that the plurality of second orifices 315 aligns with the plurality of outer orifices 304. However, as the inner check 316 is in closed position, the inner check limits any passage of second fuel through the plurality of second orifices 315 and first orifices 314. The first fuel flows through the first passage 308, and then through the plurality of outer orifices 304 and is injected in the cylinder 104 through the plurality of outer orifices 304.

FIGS. 7A-7C show the fuel injector 124 with the outer check 306 in the closed position and the inner check 316 in the open position. In this configuration, flow of the first fuel through the first passage 308 is limited as the outer check 306 is in the closed position. Referring to FIG. 7A, the plurality of first orifices 314 is aligned with the plurality of outer orifices 304. The second fuel flows through the second passage 318, and then flows through the plurality of first orifices 314. As the plurality of first orifices 314 is aligned with the plurality of outer orifices 304, the second fuel then flows through the plurality of outer orifices 304 and is injected in the cylinder 104. In this configuration, the plurality of second orifices 315 align with the inner surface 310 of the nozzle 302 and remains closed.

Referring to FIG. 7B, the outer check 306 is shown rotated compared the configuration shown in FIG. 7A. The outer check 306 may be lifted first to rotate and then brought back to the closed position. The rotation may occur when the outer check 306 is lifted to inject through plurality of outer orifices 304 as shown in FIG. 6. None of the plurality of first orifices 314 and the plurality of second orifices 315 is aligned with the plurality of outer orifices 304. The plurality of first orifices 314 and the plurality of second orifices 315 align with the inner surf ace 310 of the nozzle 302, and remain closed. Flow of the first fuel and the second fuel is limited through the first passage 308 and the second passage 318 respectively. In this configuration, none of the first fuel and the second fuel is injected in the cylinder 104. Now referring to FIG. 7C, the outer check 306 is further rotated, and the plurality of second orifices 315 align with the plurality of outer orifices 304. The outer check 306 may be lifted first to rotate and then brought back to the closed position. As the outer check 306 is in the closed position, flow of the first fuel through the first passage 308 is limited. The second fuel flows through the second passage 318, and then through the plurality of second orifices 315 and the plurality of outer orifices 304, and is injected in the cylinder 104.

Another embodiment of the present disclosure may be envisioned with combined reference to FIGS. 6A-6C and FIGS. 7A-7C. The fuel injector 124 may also be used to sequentially inject the first fuel and/or the second fuel in the cylinder 104. It should be contemplated that the first fuel and the second fuel may be injected in any order as per application requirements. The present disclosure is not limited by order of injection of the first fuel and the second fuel in any manner. Referring to FIGS. 6A-6C the controller 208 may control the position of the outer check 306 and the inner check 316 such that the outer check 306 is in the open position and the inner check 316 is in the closed position. The controller 208 may also control rotation of outer check 306. The first fuel flows through the first passage 308, then through the plurality of outer orifices 304, and is sequentially injected in the cylinder 104 through the plurality of outer orifices 304. As the inner check 316 is in the closed position, there is no injection through the plurality of first orifices 314 and the plurality of second orifices 315.

Now referring to FIGS. 7A-7C, the controller 208 may control the position of the outer check 306 and the inner check 316, such that the outer check 306 is in the closed position, and the inner check 316 is in the open position. Any one of the plurality of first orifices 314 (as shown in FIG. 7A), or the plurality of second orifices 315 (as shown in FIG. 7C) may be aligned with the plurality of outer orifices 304. The second fuel flows through the second passage 318, and then through any one of the plurality of first orifices 314, or the plurality of second orifices 315 based on the alignment with the plurality of outer orifices 304, and is sequentially injected in the cylinder 104 through the plurality of outer orifices 304. For example, when the plurality of first orifices 314 align with the plurality of outer orifices 304, the plurality of second orifices 315 align with the inner surface 310 of the nozzle 302. Similarly, when the plurality of second orifices 315 align with the plurality of outer orifices 304, the plurality of first orifices 314 align with the inner surface 310 of the nozzle 302.

INDUSTRIAL APPLICABILITY

Figure 8:
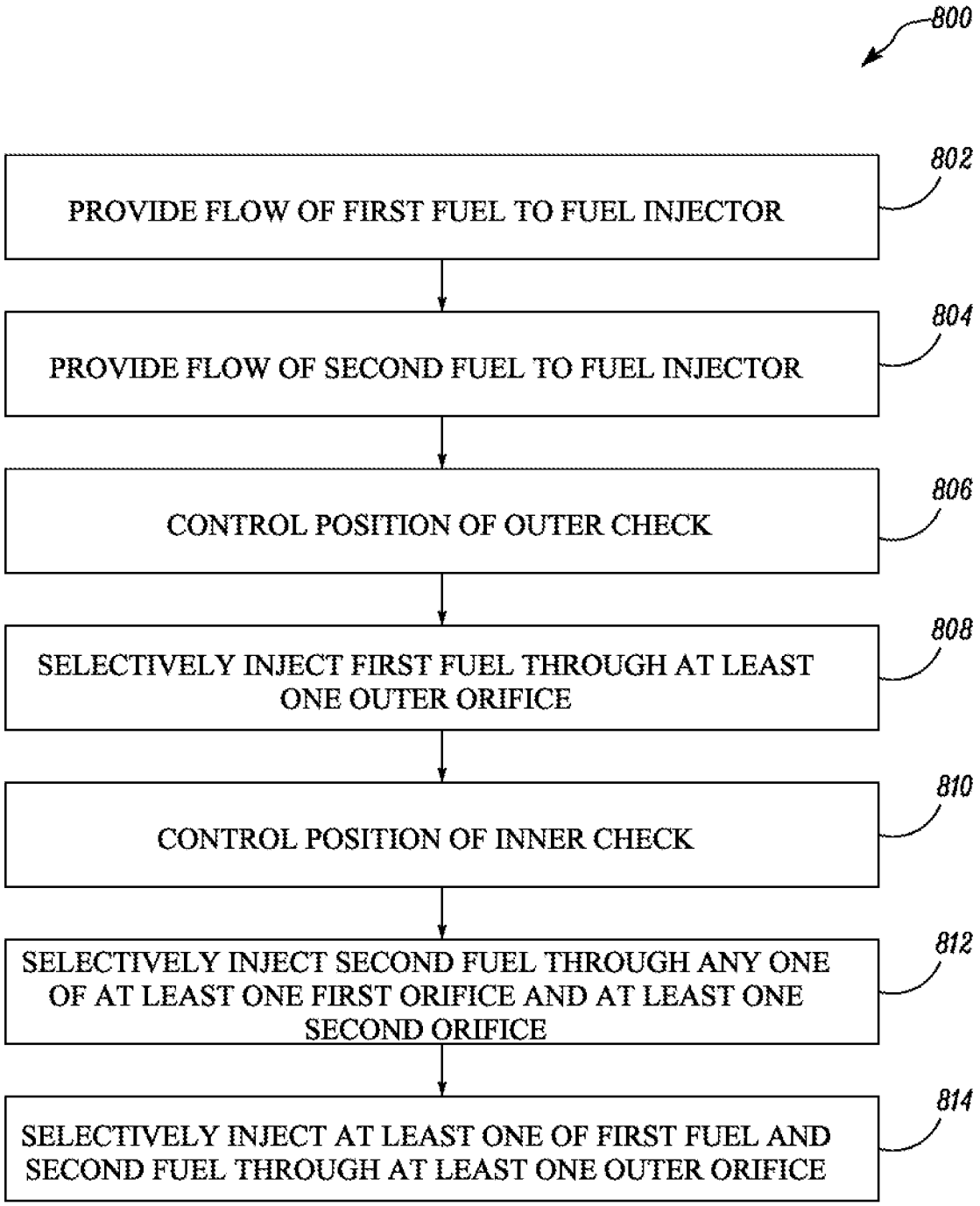
FIG. 8 illustrates a flow chart of a method for controlling the fuel injector of FIG. 3A, in accordance with an embodiment of the present disclosure.

The present disclosure provides a method 800 as shown in FIG. 8 for controlling the fuel injector 124. The fuel injector 124 includes the nozzle 302, the outer check 306, and the inner check 316, and any other components which may be necessary for operation of the fuel injector 124. At step 802, the fuel injector 124 is provided with the flow of the first fuel. The first fuel is supplied by the first fuel source 202, and the controller 208 may control the supply of the first fuel to the fuel injector 124. At step 804, the fuel injector 124 is provided with the flow of the second fuel. The second fuel is supplied, by the second fuel source 204, and the controller 208 may control the supply of the second fuel to the fuel injector 124.

At step 806, position of the outer check 306 is controlled. The controller 208 may control the translation of the outer check 306 to move the outer check 306 between the open position and the closed position. Further, the controller 208 may also control rotational motion of the outer check 306 with respect to the nozzle 302 to selectively align any one of the plurality of first orifices 314 and the plurality of second orifices 315 with the plurality of outer orifices 304. At step 808, the first fuel is selectively injected through the plurality of outer orifices 304 with the outer check 306 in the open position. The controller 208 may control the rotational movement of the outer check 306 to selectively align any one of the plurality of first orifices 314 and the plurality of second orifices 315 as per operational requirements of the engine 100, as both the plurality of first orifices 314 and the plurality of second orifices 315 may offer different injection patterns and profiles. The controller 208 may control duration of injection to control amount of the first fuel being injected as per operational requirements of the engine 100.

At step 810, the position of the inner check 316 is controlled. The controller 208 may control the translation of the inner check 316 to move the inner check 316 between the open position and the closed position. At step 812, the second fuel is selectively injected through any one of the plurality of first orifices 314 and the plurality of second orifices 315. The second fuel is injected through the plurality of first orifices 314 if the plurality of first orifices 314 align with the plurality of outer orifices 304, and the second fuel is injected through the plurality second orifices 315 if the plurality of second orifices 315 align with the plurality of outer orifices 304.

At step 814, the second fuel flows through any one of the plurality of first orifices 314 or the plurality of second orifices 315, and then flows through the plurality of outer orifices 304. The controller 208 may control the position of the outer check 306 and the inner check 316 such that the first fuel and the second fuel are injected sequentially in the cylinder 104.

The fuel injector 124 provided by the present disclosure may be used to inject the first fuel and the second fuel independently in a sequential manner. The fuel injector 124 may also be used for injecting the fuel in more than one injection profiles and patterns, as the plurality of first orifices 314 and the plurality of second orifices 315 may offer different injection profiles. The present disclosure in not limited by the number of injection profiles as well. There may be any number of set of orifices corresponding to varying injection profiles, which may be used to inject the fuel as per operational requirements. The fuel injector 124 may therefore cater to changing requirements of afferent application areas, and suit the needs of fuel supply accordingly.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A fuel injector comprising:

a nozzle including at least one outer orifice provided therein, the at least one outer orifice adapted to selectively inject a first fuel therethrough;

an outer check disposed movably within the nozzle, the outer check including at least one first orifice and at least one second orifice provided therein, the at least one first orifice and the at least one second orifice disposed circumferentially spaced apart with respect to one another, each of the at least one first orifice and the at least one second orifice adapted to selectively inject a second fuel therethrough; and an inner check disposed movably and concentrically within the outer check, wherein:

the at least one outer orifice is adapted to selectively inject the first fuel or the second fuel therethrough based on a position of each of the outer check and the inner check, and the selective injection of the second fuel through the at least one outer orifice is according to selective and exclusive alignment of only one of the at least one first orifice and the at least one second orifice of the outer check with the at least one first orifice of the nozzle such that the second fuel is outputted by said only one of the at least one first orifice and the at least one second orifice that is exclusively aligned with the at least one outer orifice and not by the other of the at least one first orifice and the at least one second orifice.

2. The fuel injector of claim 1 further includes:

a first passage provided between the nozzle and the outer check, the first passage adapted to allow flow of the first fuel therethrough, wherein the first passage is adapted to be selectively connected to the at least one outer orifice based on the position of the outer check; and a second passage provided between the outer check and the inner check, the second passage adapted to allow flow of the second fuel therethrough, wherein the second passage is adapted to be selectively connected to each of the at least one first orifice and the at least one second orifice based on the position of the inner check.

3. The fuel injector of claim 1, wherein the outer check is rotatable about a central axis to selectively and exclusively align said only one of the at least one first orifice and the at least one second orifice with respect to the at least one outer orifice of the nozzle such that the second fuel is outputted by said only one of the at least one first orifice and the at least one second orifice that is exclusively aligned with the at least one outer orifice and not by the other of the at least one first orifice and the at least one second orifice.

4. The fuel injector of claim 1, wherein:

the at least one outer orifice includes a plurality of outer orifices, each of the plurality of outer orifices disposed circumferentially spaced apart with respect to one another, the at least one first orifice includes a plurality of first orifices, each of the plurality of first orifices disposed circumferentially spaced apart with respect to one another, and the at least one second orifice includes a plurality of second orifices, each of the plurality of second orifices disposed circumferentially spaced apart with respect to one another and each of the plurality of first orifices.

5. The fuel injector of claim 4, wherein:

the plurality of outer orifices is provided at a first included angle, the plurality of first orifices is provided at a second included angle, and the plurality of second orifices is provided at a third included angle, such that each of the first included angle, the second included angle, and the third included angle is different with respect to one another.

6. The fuel injector of claim 4, wherein:

the plurality of outer orifice is provided at a first included angle, the plurality of first orifice is provided at a second included angle, and the plurality of second orifice is provided at a third included angle, such that each of the first included angle, the second included angle, and the third included angle is equal to one another.

7. The fuel injector of claim 1, wherein each of the first fuel and the second fuel is any one of natural gas, alcohol, diesel, and gasoline.

8. The fuel injector of claim 1, wherein the first fuel is the same as the second fuel.

9. The fuel injector of claim 1, wherein:

the at least one first orifice includes a plurality of first orifices, the at least one second orifice includes a plurality of second orifices, and a total number of the plurality of first orifices is greater than a total number of the plurality of second orifices.

10. A fuel injection system comprising:

a first fuel source adapted to provide a first fuel therefrom;

a second fuel source adapted to provide a second fuel therefrom;

a fuel injector provided in fluid communication with each of the first fuel source and the second fuel source, the fuel injector comprising:

a nozzle including at least one outer orifice provided therein, the at least one outer orifice adapted to selectively inject the first fuel therethrough;

an outer check disposed movably within the nozzle, the outer check including at least one first orifice and at least one second orifice provided therein, the at least one first orifice and the at least one second orifice disposed circumferentially spaced apart with respect to one another, each of the at least one first orifice and the at least one second orifice adapted to selectively inject the second fuel therethrough; and an inner check disposed movably and concentrically within the outer check, wherein the at least one outer orifice is adapted to selectively inject the first fuel or the second fuel therethrough based on a position of each of the outer check and the inner check; and a controller communicably coupled to each of the first fuel source, the second fuel source, and the fuel injector, wherein:

the controller is configured to control the selective injection of the second fuel through the at least one outer orifice by controlling the outer check according to selective and exclusive alignment of only one of the at least one first orifice and the at least one second orifice with the at least one first orifice of the nozzle such that the second fuel is outputted by said only one of the at least one first orifice and the at least one second orifice that is exclusively aligned with the at least one outer orifice and not by the other of the at least one first orifice and the at least one second orifice.

11. The fuel injection system of claim 10, wherein the controller is configured to:

control flow of the first fuel from the first fuel source to the fuel injector;

control flow of the second fuel from the second fuel source to the fuel injector;

control a position of the outer check;

control selective injection of the first fuel through the at least one outer orifice;

control a position of the inner check;

control selective injection of the second fuel through said only one of the at least one first orifice and the at least one second orifice based on the position of the inner check; and control the selective injection of the second fuel through the at least one outer orifice based on the position of the inner check.

12. The fuel injection system of claim 11, wherein the controller is further configured to control the position of at least one of the inner check and the outer check to sequentially inject the first fuel and the second fuel through the at least one outer orifice.

13. The fuel injection system of claim 11, wherein said controlling the outer check according to selective and exclusive alignment further includes rotating the outer check about a central axis to selectively align said one of the at least one first orifice and the at least one second orifice with respect to the at least one outer orifice of the nozzle such that the second fuel is outputted by said only one of the at least one first orifice and the at least one second orifice that is exclusively aligned with the at least one outer orifice and not by the other of the at least one first orifice and the at least one second orifice.

14. The fuel injection system of claim 10, wherein:

the at least one outer orifice includes a plurality of outer orifices, each of the plurality of outer orifices disposed circumferentially spaced apart with respect to one another, the at least one first orifice includes a plurality of first orifices, each of the plurality of first orifices disposed circumferentially spaced apart with respect to one another, and the at least one second orifice includes a plurality of second orifices, each of the plurality of second orifices disposed circumferentially spaced apart with respect to one another and each of the plurality of first orifices.

15. The fuel injection system of claim 14, wherein:

the plurality of outer orifices is provided at a first included angle, the plurality of first orifices is provided at a second included angle, and the plurality of second orifices is provided at a third included angle, such that each of the first included angle, the second included angle, and the third included angle is equal to one another.

16. The fuel injection system of claim 14, wherein:

the at least one outer orifice is provided at a first included angle, the at least one first orifice is provided at a second included angle, and the at least one second orifice is provided at a third included angle, such that each of the first included angle, the second included angle, and the third included angle is different with respect to one another.

17. The fuel injection system of claim 11, wherein each of the first fuel and the second fuel is any one of natural gas, alcohol, diesel, and gasoline.

18. The fuel injection system of claim 11, wherein the first fuel is the same as the second fuel.

19. A method for controlling a fuel injector, the fuel injector having a nozzle, an outer check, and an inner check, the method comprising:

providing flow of a first fuel to the fuel injector;

providing flow of a second fuel to the fuel injector;

controlling positioning of the outer check;

injecting, selectively, the first fuel through at least one outer orifice;

controlling a position of the inner check and an orientation of the outer check; and injecting, selectively and exclusively, the second fuel through only one of at least one first orifice and at least one second orifice, wherein the selective injection of the second fuel is according to selective and exclusive alignment of said only one of the at least one first orifice and the at least one second orifice of the outer check with the at least one first orifice of the nozzle such that the second fuel is outputted by said only one of the at least one first orifice and the at least one second orifice that is exclusively aligned with the at least one outer orifice and not by the other of the at least one first orifice and the at least one second orifice.

20. The method of claim 19, further including:

sequentially injecting the first fuel and the second fuel through the at least one outer orifice based on the position of the inner check and the positioning and/or orientation of the outer check.

* * * * *